US011024248B2

(12) United States Patent
Hu

(10) Patent No.: US 11,024,248 B2
(45) Date of Patent: Jun. 1, 2021

(54) DRIVING DEVICE OF A DISPLAY PANEL AND DRIVING METHOD THEREOF

(71) Applicants: HKC Corporation Limited, Shenzhen (CN); Chongqing HKC Optoelectronics Technology Co., Ltd., Chongqing (CN)

(72) Inventor: Yunchuan Hu, Chongqing (CN)

(73) Assignees: HKC Corporation Limited, Shenzhen (CN); Chongqing HKC Optoelectronics Co., Ltd., Chongqing (CN)

( * ) Notice: Subject to any disclaimer, the term of this patent is extended or adjusted under 35 U.S.C. 154(b) by 0 days.

(21) Appl. No.: 16/639,713

(22) PCT Filed: Dec. 14, 2017

(86) PCT No.: PCT/CN2017/116249

§ 371 (c)(1),
(2) Date: Feb. 17, 2020

(87) PCT Pub. No.: WO2019/037347

PCT Pub. Date: Feb. 28, 2019

(65) Prior Publication Data

US 2020/0219460 A1 Jul. 9, 2020

(30) Foreign Application Priority Data

Aug. 24, 2017 (CN) ..... 201710734696.4

(51) Int. Cl.
*G09G 3/36* (2006.01)
*G09G 5/06* (2006.01)

(52) U.S. Cl.
CPC ..... *G09G 3/3688* (2013.01); *G09G 5/06* (2013.01); *G09G 2320/0242* (2013.01)

(58) Field of Classification Search
CPC ..... G09G 3/36; G09G 3/3607; G09G 3/3611; G09G 3/3622; G09G 3/3625; G09G 3/364;

(Continued)

(56) References Cited

U.S. PATENT DOCUMENTS

2003/0179170 A1* 9/2003 Lee ..... G09G 3/3648 345/87
2006/0267893 A1* 11/2006 Kim ..... G09G 3/3611 345/89

(Continued)

FOREIGN PATENT DOCUMENTS

CN 102446479 A 5/2012
CN 106205536 A 12/2016

(Continued)

*Primary Examiner* — Alexander Eisen
*Assistant Examiner* — Nelson Lam
(74) *Attorney, Agent, or Firm* — Wang Law Firm, Inc.

(57) ABSTRACT

The present application provides a driving device, a driving method and a display device of a display panel. Whether the received M-th drive data of the current row drive data needs to be compensated for or not is determined. When the compensation is needed, the M-th data of the current row drive data needing to be compensated for is compensated through the corresponding compensation drive data looked up according to the M-th drive data of the previous row drive data and the M-th drive data of the current row drive data.

15 Claims, 6 Drawing Sheets

(58) Field of Classification Search
CPC .. G09G 3/3644; G09G 3/3648; G09G 3/3674; G09G 3/3677; G09G 3/3681; G09G 3/3685; G09G 3/3688; G09G 3/3692; G09G 5/028; G09G 5/04; G09G 5/06; G09G 2320/0242
USPC ..... 345/76–83, 87–104
See application file for complete search history.

(56) References Cited

U.S. PATENT DOCUMENTS

2008/0252797 A1* 10/2008 Hamer ..... H04N 9/64 348/802
2011/0057950 A1* 3/2011 Kim ..... G09G 5/02 345/602
2011/0109662 A1* 5/2011 Cho ..... G09G 3/3688 345/690
2014/0104324 A1* 4/2014 Park ..... G09G 3/3648 345/690
2014/0132842 A1* 5/2014 Tsuchiya ..... G09G 3/3648 348/728
2014/0232765 A1* 8/2014 Ooishi ..... G09G 3/3659 345/691
2015/0154937 A1* 6/2015 Funatsu ..... G06T 11/001 345/593
2016/0071449 A1* 3/2016 Miyata ..... G09G 3/2003 345/690
2016/0379594 A1* 12/2016 Cho ..... G09G 5/04 345/601
2017/0025077 A1* 1/2017 Choi ..... G09G 3/3648
2017/0213492 A1* 7/2017 Ochiai ..... G09G 3/2059

FOREIGN PATENT DOCUMENTS

CN 107301852 A 10/2017
CN 107358926 A 11/2017

* cited by examiner

| R | G | B | R | G | B | R | G | B | R | G | B |
|---|---|---|---|---|---|---|---|---|---|---|---|
| 0 | 1 | 0 | 1 | 0 | 1 | 0 | 1 | 0 | 1 | 0 | 1 |
| 0 | 1 | 0 | 1 | 0 | 1 | 0 | 1 | 0 | 1 | 0 | 1 |

FIG. 2

DRIVING DEVICE OF A DISPLAY PANEL AND DRIVING METHOD THEREOF

CROSS-REFERENCE TO RELATED APPLICATION

This application is a National Stage Application of PCT International Patent Application No. PCT/CN2017/116249 filed on Dec. 14, 2017, under 35 U.S.C. § 371, which claims priority to and the benefit of Chinese Patent Application No. 201710734696.4, filed on Aug. 24, 2017, and the disclosure of which is incorporated herein in its entirety by reference.

TECHNICAL FIELD

The present application relates to the field of display technology, and especially relates to the driving device, the driving method and the display device of a display panel.

DISCUSSION OF THE RELATED ART

With the continuous development of display technology, display devices such as display panels and displays are constantly developed in the direction of being thin, large-screen, low-power and low-cost. At present, the dual gate driving architecture is widely used for driving liquid crystal display panels. Compared to the conventional driving architecture, the number of the gate lines of the dual gate driving architecture is doubled and the number of the data lines is halved so as to correspondingly reduce the number of the source chips (source IC) and the manufacturing cost.

However, due to doubling the number of the gate lines, the time for writing data in the sub-pixels of the rows of the dual gate driving architecture is halved such that when the driving polarization is reversed, the charging time of the liquid crystals of the sub-pixels with polarization reversal is not enough due to the data delay and a light and dark striped pattern or the grid phenomenon may occur in the liquid crystal display panel.

SUMMARY

The present application provides a driving device, a driving method and a display device of a display panel and intends to solve the problem where, when the number of the gate lines is doubled, the time for writing data in the sub-pixels of the rows of the dual gate driving architecture is halved such that when the driving polarization is reversed, the charging time of the liquid crystals of the sub-pixels with polarization reversal is not enough due to the data delay and a light and dark striped pattern or the grid phenomenon may occur in the liquid crystal display panel.

One embodiment of the present application provides a driving device of a display panel comprising: a judging parameter look-up module configured to look up a judging parameter in a judging parameter look-up table stored in the judging parameter look-up module in advance and output a M-th drive data of the current row drive data according to the judging parameter when receiving the M-th drive data of the current row drive data and a M-th control signal of the current row control signal; wherein the judging parameter corresponds to the M-th drive data of the current row drive data and the M-th control signal of the current row control signal, M≥1 and M is a positive integer; a drive data storage module connected to the judging parameter look-up module and configured to store a M-th drive data of the previous row drive data in advance and to get and to store the M-th drive data of the current row drive data when the judging parameter is determined to be a first parameter, the first parameter being used to indicate that the M-th drive data of the current row drive data needs to be compensated for; a compensation parameter look-up module connected to the judging parameter look-up module and the drive data storage module respectively and configured to look up a compensation drive data in a compensation parameter look-up table stored in the compensation parameter look-up module in advance and output the compensation drive data when the judging parameter is determined to be the first parameter; wherein the compensation drive data corresponds to the M-th drive data of the previous row drive data and the M-th drive data of the current row drive data; and a data buffering module connected to the judging parameter look-up module and the compensation parameter look-up module and configured to get, buffer, and then output the M-th drive data of the current row drive data when the judging parameter is determined to be a second parameter; the data buffering module buffering and outputting the compensation drive data after getting the compensation drive data.

Preferably, the display panel may comprise sub-pixels in the pattern of m rows and n columns, each column of the sub-pixels comprises a plurality of sets of the sub-pixels, and each set of the sub-pixels comprises a first color sub-pixel, a second color sub-pixel and a third color sub-pixel arranged in sequence; wherein n≥m≥1 and m and n are positive integers.

Preferably, the compensation parameter look-up table may comprise a first compensation parameter look-up table, a second compensation parameter look-up table and a third compensation parameter look-up table corresponding to the first color sub-pixel, the second color sub-pixel and the third color sub-pixel respectively.

Preferably, the compensation parameter look-up module may comprise: a first compensation parameter look-up unit configured to store the first compensation parameter look-up table in advance and, when Mod (M,3)=1, look-up and output the compensation drive data in the first compensation parameter look-up table; a second compensation parameter look-up unit configured to store the second compensation parameter look-up table in advance and, when Mod (M,3) =2, look-up and output the compensation drive data in the second compensation parameter look-up table; a third compensation parameter look-up unit configured to store the third compensation parameter look-up table in advance and, when Mod (M,3)=0, look-up and output the compensation drive data in the third compensation parameter look-up table.

Preferably, the compensation parameter look-up module may further be configured to look up a numeral value range in the compensation parameter look-up table when the judging parameter is determined to be the first parameter, the numeral value range corresponds to the M-th drive data of the previous row drive data and the M-th drive data of the current row drive data; and wherein the compensation parameter look-up module is further configured to calculate numeral values in the numeral value range through the interpolation method to get the compensation drive data.

Preferably, a first input terminal of the judging parameter look-up module may input the control signal, a second input terminal of the judging parameter look-up module inputs the drive data, a first output terminal of the judging parameter look-up module connects to a first input terminal of the data buffering module, a second output terminal of the judging parameter look-up module, a input/output terminal of the drive data storage module and a input terminal of the compensation parameter look-up module connect to each other; an output terminal of the compensation parameter look-up module connects to a second input terminal of the data buffering module; and an output terminal of the data buffering module outputs data to the sub-pixels of each row of the display panel.

Another embodiment of the present application further provides a driving method of a display panel comprising: controlling a judging parameter look-up module to look up a judging parameter in a judging parameter look-up table stored in the judging parameter look-up module in advance when the judging parameter look-up module receives a M-th drive data of the current row drive data and a M-th control signal of the current row control signal, and to output the M-th drive data of the current row drive data according to the judging parameter; wherein the judging parameter corresponds to the M-th drive data of the current row drive data and the M-th control signal of the current row control signal, M≥1 and M is a positive integer; controlling a drive data storage module to get and store the M-th drive data of the current row drive data when the judging parameter is determined to be a first parameter, the first parameter being used to indicate that the M-th drive data of the current row drive data needs to be compensated for; controlling a compensation parameter look-up module to look up and output a compensation drive data in a compensation parameter look-up table stored in the compensation parameter look-up module in advance for when the judging parameter is determined to be the first parameter; wherein the compensation drive data corresponds to a M-th drive data of the previous row drive data and the M-th drive data of the current row drive data; controlling a data buffering module to get the M-th drive data of the current row drive data and to buffer and then output the M-th drive data of the current row drive data; controlling the data buffering module to buffer and output the compensation drive data when the data buffering module receives the compensation drive data.

Preferably, the display panel may comprise sub-pixels in the pattern of m rows and n columns, each column of the sub-pixels comprises a plurality of sets of the sub-pixels, and each set of the sub-pixels comprises a first color sub-pixel, a second color sub-pixel and a third color sub-pixel arranged in a sequence; wherein n≥m≥1 and m and n are positive integers.

Preferably, the compensation parameter look-up table may comprise: a first compensation parameter look-up table corresponding to the first color sub-pixel; a second compensation parameter look-up table corresponding to the second color sub-pixel; and a third compensation parameter look-up table corresponding to the third color sub-pixel.

Preferably, the compensation parameter look-up module looks up and outputs the compensation drive data in the compensation parameter look-up table stored in the compensation parameter look-up module in advance may comprise: controlling the compensation parameter look-up module to look up and output the compensation drive data in the first compensation parameter look-up table stored in the compensation parameter look-up module in advance when Mod (M, 3)=1; controlling the compensation parameter look-up module to look up and output the compensation drive data in the second compensation parameter look-up table stored in the compensation parameter look-up module in advance when Mod (M, 3)=2; controlling the compensation parameter look-up module to look up and output the compensation drive data in the third compensation parameter look-up table stored in the compensation parameter look-up module in advance when Mod (M, 3)=0.

Preferably, controlling the compensation parameter look-up module to look up and output the compensation drive data in the compensation parameter look-up table stored in the compensation parameter look-up module in advance may comprise: controlling the compensation parameter look-up module to look up a numeral value range in the compensation parameter look-up table stored in the compensation parameter look-up module in advance when the judging parameter is determined to be the first parameter, the numeral value range corresponding to the M-th drive data of the previous row drive data and the M-th drive data of the current row drive data; and controlling the compensation parameter look-up module to calculate numeral values in the numeral value range through the interpolation method to get the compensation drive data.

Preferably, a first input terminal of the judging parameter look-up module may input the control signal, a second input terminal of the judging parameter look-up module inputs the drive data, a first output terminal of the judging parameter look-up module connects to a first input terminal of the data buffering module, a second output terminal of the judging parameter look-up module, a input/output terminal of the drive data storage module and a input terminal of the compensation parameter look-up module connect to each other; an output terminal of the compensation parameter look-up module connects to a second input terminal of the data buffering module; and an output terminal of the data buffering module outputs data to the sub-pixels of each row of the display panel.

Another embodiment of the present application further provides a driving device of a display panel comprising: a judging parameter look-up module configured to look up a judging parameter in a judging parameter look-up table stored in the judging parameter look-up module in advance and output a M-th drive data of the current row drive data according to the judging parameter when receiving the M-th drive data of the current row drive data and a M-th control signal of the current row control signal; wherein the judging parameter corresponds to the M-th drive data of the current row drive data and the M-th control signal of the current row control signal, M≥1 and M is a positive integer; wherein the judging parameter comprises a first parameter indicating that the M-th drive data of the current row drive data needs to be compensated for and a second parameter indicating that the M-th drive data of the current row drive data do not need to be compensated for; a drive data storage module connected to the judging parameter look-up module and configured to store a M-th drive data of the previous row drive data in advance and to get and to store the M-th drive data of the current row drive data when the judging parameter is determined to be the first parameter; a compensation parameter look-up module connected to the judging parameter look-up module and the drive data storage module respectively and configured to look up a numeral value range in a compensation parameter look-up table stored in the compensation parameter look-up module in advance and to get and output a compensation drive data by calculating numeral values in the numeral value range through the interpolation method when the judging parameter is determined to be the first parameter; wherein the compensation drive data corresponds to the M-th drive data of the previous row drive data and the M-th drive data of the current row drive data; and a data buffering module connected to the judging parameter look-up module and the compensation parameter look-up module and configured to get, buffer and then output the M-th drive data of the current row drive data when the judging parameter is determined to be the second parameter;

the data buffering module buffering and outputting the compensation drive data after getting the compensation drive data.

Preferably, the display panel may comprise sub-pixels in the pattern of m rows and n columns, each column of the sub-pixels comprises a plurality of sets of the sub-pixels, and each set of the sub-pixels comprises a first color sub-pixel, a second color sub-pixel and a third color sub-pixel arranged in sequence; wherein n≥m≥1 and m and n are positive integers.

Preferably, the compensation parameter look-up table may comprise a first compensation parameter look-up table, a second compensation parameter look-up table and a third compensation parameter look-up table corresponding to the first color sub-pixel, the second color sub-pixel and the third color sub-pixel respectively.

Preferably, the compensation parameter look-up module may comprise: a first compensation parameter look-up unit configured to store the first compensation parameter look-up table in advance and, when Mod (M,3)=1, look-up and output the compensation drive data in the first compensation parameter look-up table; a second compensation parameter look-up unit configured to store the second compensation parameter look-up table in advance and, when Mod (M,3) =2, look-up and output the compensation drive data in the second compensation parameter look-up table; a third compensation parameter look-up unit configured to store the third compensation parameter look-up table in advance and, when Mod (M,3)=0, look-up and output the compensation drive data in the third compensation parameter look-up table.

Preferably, the numeral value range may correspond to the M-th drive data of the previous row drive data and the M-th drive data of the current row drive data.

Preferably, a first input terminal of the judging parameter look-up module may input the control signal, a second input terminal of the judging parameter look-up module inputs the drive data, a first output terminal of the judging parameter look-up module connects to a first input terminal of the data buffering module, a second output terminal of the judging parameter look-up module, a input/output terminal of the drive data storage module and a input terminal of the compensation parameter look-up module connect to each other; an output terminal of the compensation parameter look-up module connects to a second input terminal of the data buffering module; and an output terminal of the data buffering module outputs data to the sub-pixels of each row of the display panel.

The present application determines whether the M-th drive data of the row drive data currently received needs to be compensated for or not. When the compensation is needed, the M-th data of the current row drive data needing to be compensated for is compensated through the corresponding compensation drive data looked up according to the M-th drive data of the previous row drive data and the M-th drive data of the current row drive data. The light and dark stripes or the grid phenomenon of the liquid crystal display panel may effectively be eliminated.

BRIEF DESCRIPTION OF THE DRAWINGS

In order to illustrate the technical plan of in the embodiments of the present application more clearly, the following will simply introduce the accompanying drawings required in the description of the embodiments. Apparently, the accompanying drawings in the following description show some embodiments of the present application, and a person of ordinary skill in the art may further obtain other accompanying drawings according to these accompany drawings without making creative effort.

FIG. 2 is the illustration of a judging parameter look-up table according to another embodiment of the present application;

DETAILED DESCRIPTION

For the purposes of better understanding of the present application for a person skilled in the art, hereinafter, the technical proposal in the embodiments of the present application will be clearly described with reference to the accompanying drawings in the embodiments of the present application. Apparently, the described embodiments are a part of the embodiments of the present application, but not all of the embodiments of the present application. All of other embodiments obtained by a person of ordinary skill in the art based on the embodiments of the present application without creative efforts should belong to the protection scope of the present application.

Those terms "comprising" and the variations thereof in the specification, claims and the accompanying drawings described above are intended to cover non-exclusive inclusion. For example, a process, method or system, product or apparatus comprising a series of steps or units is not limited to the steps or units listed, but may optionally comprise the steps or units not listed or may optionally comprise other steps or units inherent in those process, method, product or device. In addition, the terms "first", "second" and "third" are used to distinguish different articles rather than to describe a specific order.

Figure 1:
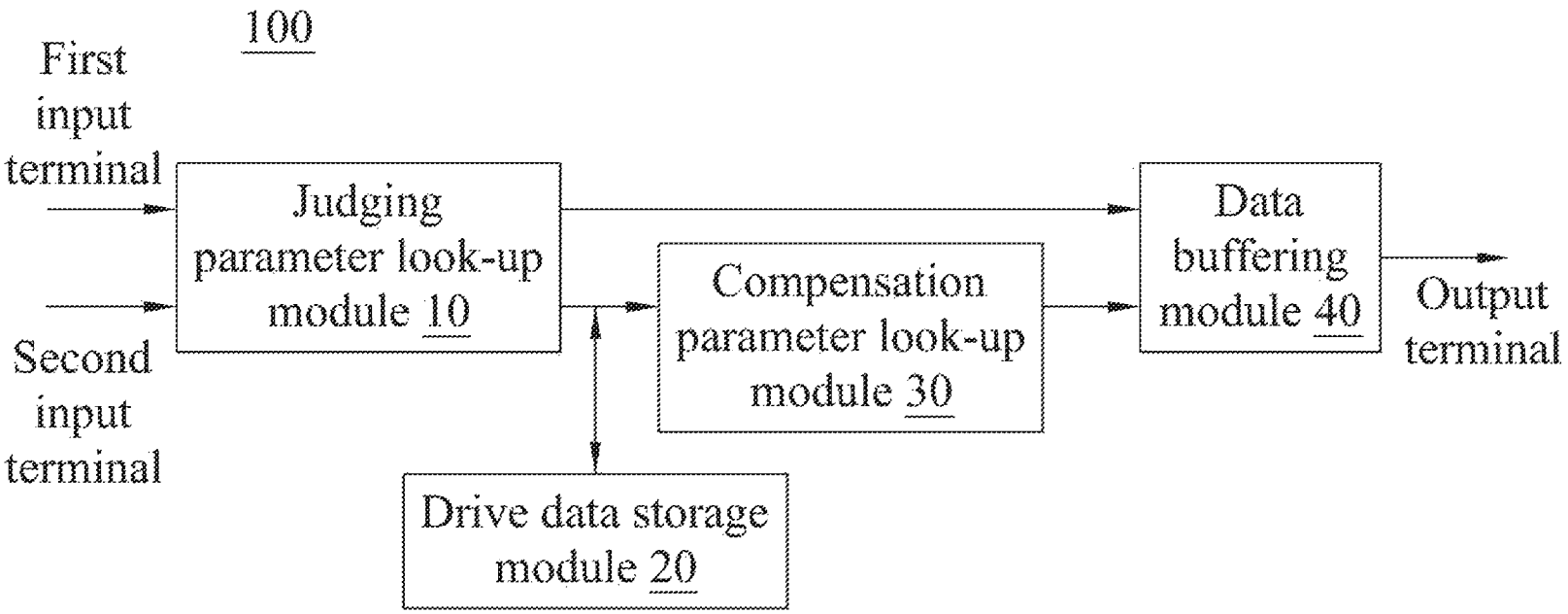
FIG. 1 is the structure illustration of a driving device of a display panel according to an embodiment of the present application.

As shown in FIG. 1, an embodiment of the present application provides a driving device 100 for a display panel comprising the judging parameter look-up module 10, the drive data storage module 20, the compensation parameter look-up module 30 and the data buffering module 40.

The first input terminal of the judging parameter look-up module 10 inputs the control signal (DE), the second input terminal of the judging parameter look-up module 10 inputs the drive data (Data), the first output terminal of the judging parameter look-up module 10 connects to the first input terminal of the data buffering module 40, and the second output terminal of the judging parameter look-up module 10, the input/output terminal of the drive data storage module 20 and the input terminal of the compensation parameter look-up module 30 connect to each other. The output terminal of the compensation parameter look-up module 30 connects to the second input terminal of the data buffering module 40, and the output terminal (Data out) of the data buffering module 40 outputs the data to the sub-pixels of each row on the display panel.

The judging parameter look-up module 10 stores a judging parameter look-up table in advance. The judging parameter look-up module 10 is configured to look up the judging parameters in the judging parameter look-up table and to output the M-th drive data of the current row drive data according to the judging parameters, when receiving the M-th drive data of the current row drive data and the M-th control signal of the current row control signal; wherein the judging parameters correspond to the M-th drive data of the current row drive data and the M-th control signal of the current row control signal, M≥1 and M is a positive integer.

In the specific application, the display panel comprises the pixel array consisting of the sub-pixels of a plurality of rows and columns. The sub-pixels of the rows connect to the source drive module and the sub-pixels of the columns connect to the gate drive module. The number of the rows and the columns of the pixel array may be configured according to the specific needs. In the embodiment, the size of the pixel array is not particularly limited. In the specific application, the source drive module may be any device or circuit having the data driving function running on the pixels of the display panel, for example, the source driver IC or the source-chip on film (S-COF), or the like. The gate drive module may be any device or circuit having the scan charging function running on the pixels of the display panel, for example, the gate driver IC or the gate-chip on film (G-COF), or the like.

In the embodiment, the current row drive data specifically refers to the data for the voltage driving running on the current row sub-pixels, and is specifically used to realize the control of the brightness of the current row sub-pixels. The current row control data specifically refers to the data for controlling the on-state and the off-state of the current row sub-pixels, and is specifically used to realize the light-up and light-off control over the current row sub-pixels. The M-th drive data specifically refers to the data used to drive the sub-pixels positioned on the M-th column of the current row sub-pixels, similarly, the M-th control signal specifically refers to the data used to control the sub-pixels positioned on the M-th column of the current row sub-pixels.

In an embodiment, the judging parameter look-up table may specifically be a look-up table (LUT), and also may be other tables having the equivalent function of data input, that is, looking the corresponding output data up according to the input data or the random access memory (RAM) kind of storage medium.

In the embodiment, the judging parameter specifically refers to the parameter indicating whether the M-th drive data of the current row drive data needs to be compensated for. If the brightness of the sub-pixel driven by the current row drive data is less than the desired brightness, the current row drive data needs to be compensated for, otherwise, the current row drive data do not need to be compensated for.

In the embodiment, the judging parameters specifically including the first parameter used to indicate that the M-th drive data of the previous row drive data needs to be compensated for and the second parameter used to indicate that the M-th drive data of the current row drive data do not need to be compensated for.

In the specific application, the first parameter may specifically be a value of 1 and the second parameter may specifically be a value of 0. In other embodiments, the first parameter and the second parameter may be equivalently replaced with other numerical values or functions having the same meaning.

In an embodiment, the display panel comprises the sub-pixels in the pattern of m rows and n columns, that is, the display panel comprises a sub-pixel array of m×n sub-pixels. Each column of the sub-pixels comprises a plurality of sets of the sub-pixels. Each set of the sub-pixels comprises the first color sub-pixel, the second color sub-pixel and the third color sub-pixel sequentially arranged, wherein n≥M≥1 and m and n are both a positive integer.

In an embodiment, in the sub-pixel array described above, the sub-pixels positioned on the same row have the same color and the color of adjacent sub-pixels is different.

In the specific application, the first color sub-pixel, the second color sub-pixel and the third color sub-pixel respectively are any one of a red sub-pixel, a green sub-pixel and a blue sub-pixel, and the color of the first color sub-pixel, the second color sub-pixel and the third color sub-pixel are different from each other.

As shown in FIG. 2, an embodiment of the present application exemplarily discloses a judging parameter look-up table with 3 rows and 12 columns. In the judging parameter look-up table, R represents the red sub-pixel, G represents the green sub-pixel, B represents the blue sub-pixel, 0 represents that the compensation is not needed and 1 represents that the compensation is needed.

The look-up table shown in FIG. 2 mainly applies to the condition, in which the display panel comprises the sub-pixels in the pattern of m rows and n columns, each column of the sub-pixels comprises a plurality of sets of the sub-pixels and each set of the sub-pixels comprises the red sub-pixel, the green sub-pixels and the blue sub-pixels, wherein 12≥n≥M≥1 and m and n are both a positive integer.

The drive data storage module 20 is used to store the M-th drive data of the previous row drive data, and then getting and storing the M-th drive data of the current row drive data when the judging parameter is determined to be the first parameter.

The compensation parameter look-up module 30 is used to look up the compensation drive data in the compensation parameter look-up table stored in compensation parameter look-up module 30 in advance and output the compensation drive data when the judging parameter is determined to be the first parameter, wherein the compensation drive data corresponds to the M-th drive data of the previous row drive data and the M-th drive data of the current row drive data.

In the specific application, the working principle of the compensation parameter look-up module is the same with the working principle of the liquid crystal driving technology commonly used in the art, that is, the compensation drive data looked up in the compensation parameter look-up table stored in advance is used to drive the display panel by comparing the M-th data of the current row drive data with the M-th data of the previous row drive data. The numeral value of the compensation drive data is proportional to the voltage of the drive voltage used to drive the display panel and similarly proportional to the gray level of the display panel. Because the main purpose of the present application is to deal with the condition in which the brightness of the sub-pixels is less than the desired brightness due to the polarity reversal, the numeral value of the compensation drive data looked up in the look-up table would be greater than the original value.

In an embodiment, the compensation parameter look-up module may specifically be the liquid crystal over drive controller (ODC, over drive controller) based on the liquid crystal over drive technology having the function of liquid crystal overdriving or other devices having the equivalent function of looking up the data and outputting the data. The specific manner thereof for the implementation is not limited in the embodiment.

In an embodiment, the compensation parameter look-up table may specifically be a look-up-table (LUT, look-up-table) and also may be other tables having the equivalent function of data input, that is, looking the corresponding output data up according to the input data or the random access memory (RAM) kind of storage medium.

In an embodiment, the compensation parameter look-up module 30 is used to look up the numeral value range in the compensation parameter look-up table when the judging parameter is determined to be the first parameter, wherein the numeral value range corresponds to the M-th drive data of the previous row drive data and the M-th drive data of the current row drive data.

The numeral values in the numeral value range are calculated through the interpolation method to obtain the compensation drive data.

In the specific application, one may swiftly obtain the compensation drive data and improve the efficiency of data searching by looking up the corresponding digital area as the description above and further calculating the compensation drive data through the interpolation method.

The data buffering module 40 is used to obtain the M-th drive data of the current row drive data, buffer it and then output it when the judging parameter is determined to be the second parameter. When receiving the compensation drive data, the data buffering module 40 is further used to buffer it and then output it.

In the specific application, the second parameter is used to indicate the M-th drive data of the current row drive data do not need to be compensated for.

In an embodiment, the data buffering module may be a buffer and also may be other memory devices having the equivalent buffer storage function. In the embodiment, no specific limitation is imposed on the data buffering module.

In the embodiment, whether the M-th drive data of the row drive data received currently needs to be compensated for or not is determined. When the compensation is needed, the M-th data of the current row drive data needing to be compensated for is compensated through the corresponding compensation drive data looked up according to the M-th drive data of the previous row drive data and the M-th drive data of the current row drive data so as to effectively eliminate the light and dark stripes or the grid phenomenon of the liquid crystal display panel.

In an embodiment, the compensation parameter look-up table stored in the compensation parameter look-up module comprises the first compensation parameter look-up table, the second compensation parameter look-up table and the third compensation parameter look-up table, and the compensation parameter for the sub-pixels of different colors may be looked up in the look-up table corresponding to the color of the sub-pixel. For example, if the M-th data of the current row drive data is used to drive the data of the first color sub-pixel, the corresponding compensation parameter is looked up from the first compensation parameter look-up table; if the M-th data of the current row drive data is used to drive the data of the second color sub-pixel, the corresponding compensation parameter is looked up from the second compensation parameter look-up table; if the M-th data of the current row drive data is used to drive the data of the third color sub-pixel, the corresponding compensation parameter is looked up from the third compensation parameter look-up table.

In an embodiment, when one drive datum of the previous row drive data is 16 and one drive datum of the current row drive data is 48, the corresponding compensation drive data actually outputted is 52 looked up via the compensation parameter look-up table. When one drive datum of the previous row drive data is 112 and one drive datum of the current row drive data is 192, the corresponding compensation drive data actually outputted is 208 looked up via the compensation parameter look-up table.

Figure 3:
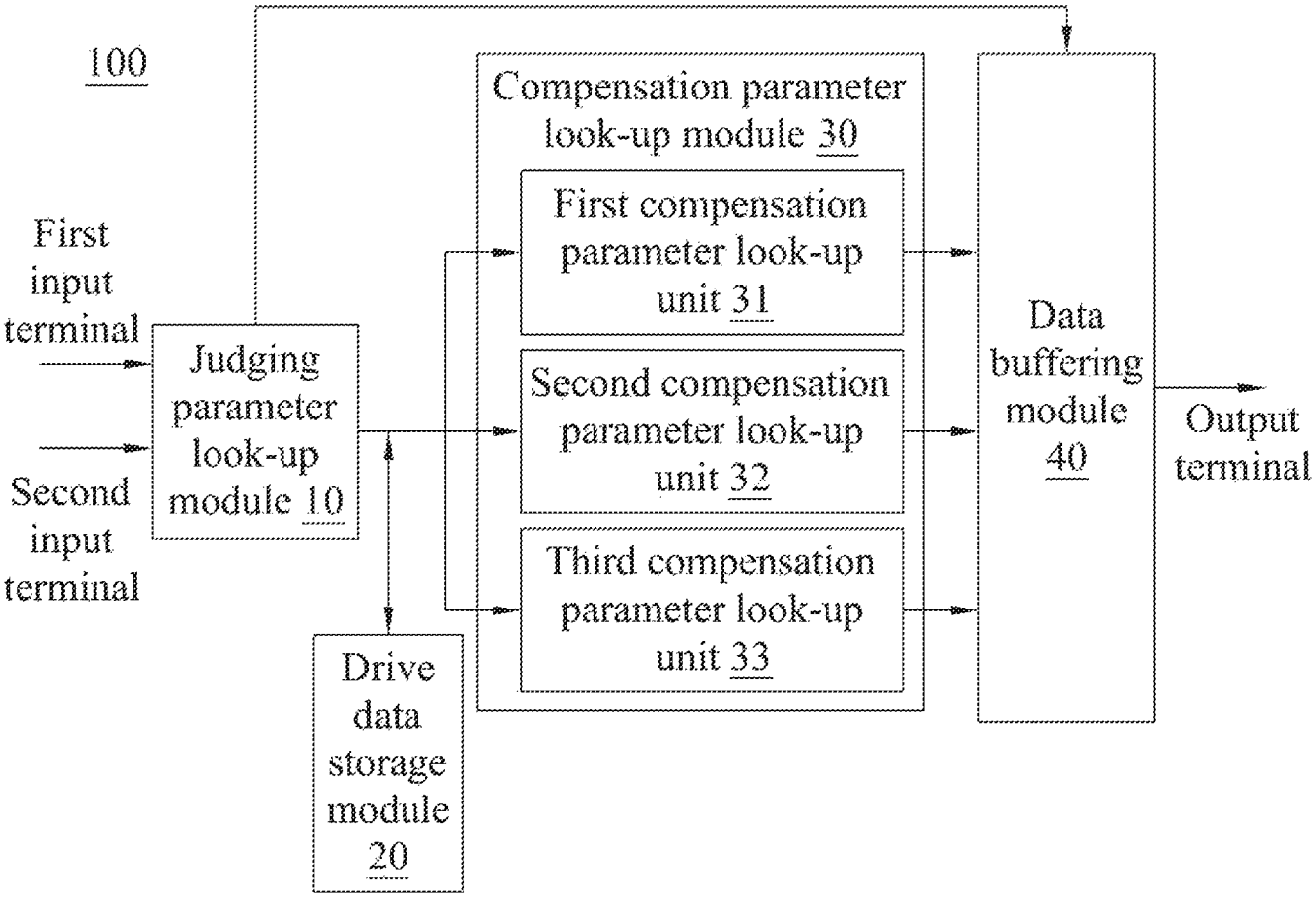
FIG. 3 is the structure illustration of a driving device of a display panel according to another embodiment of the present application.

As shown in FIG. 3, in an embodiment, the compensation parameter look-up module 30 comprises the first compensation parameter look-up unit 31, the second compensation parameter look-up unit 32 and the third compensation parameter look-up unit 33.

The relation between the first compensation parameter look-up unit 31, the second compensation parameter look-up unit 32 and the third compensation parameter look-up unit 33 is parallel. The terminals of the three units, the second output terminal of the judging parameter look-up module 10 and the input/output terminal of the drive data storage module 20 connect to each other. The terminals of the three units connect to the second input terminal of the data buffering module 40.

The first compensation parameter look-up unit 31 is used to store the first compensation parameter look-up table in advance and look up the corresponding compensation drive data in the first compensation parameter look-up table and output it when Mod (M, 3)=1.

The second compensation parameter look-up unit 32 is used to store the second compensation parameter look-up table in advance and look up the corresponding compensation drive data in the second compensation parameter look-up table and output it when Mod (M, 3)=2.

The third compensation parameter look-up unit 33 is used to store the third compensation parameter look-up table in advance and look up the corresponding compensation drive data in the third compensation parameter look-up table and output it when Mod (M, 3)=0.

In the embodiment, Mod (number, divisor) function represents the remainder function, wherein "number" represents the dividend and "divisor" represents the divisor.

In the specific application, the working principle of the first compensation parameter look-up unit 31, the second compensation parameter look-up unit 32 or the third compensation parameter look-up unit 33 is the same with the working principle of the liquid crystal driving technology commonly used in the art, that is, driving the display panel by looking up a datum corresponding to the M-th drive data of the current row drive data and the M-th drive data of the previous row drive data in the compensation parameter look-up table stored in advance with a greater or smaller numeral value than the current row drive data by comparing the M-th data of the current row drive data with the M-th data of the previous row drive data. The numeral value of the drive data is proportional to the voltage of the drive voltage used to drive the display panel and similarly proportional to the gray level of the display panel. Because the main purpose of the present application is to deal with the condition in which the brightness of the sub-pixels is less than the desired brightness due to the polarity reversal, the numeral value of the drive data looked up in the look-up table would be greater than the original value.

In an embodiment, the first compensation parameter look-up unit 31, the second compensation parameter look-up unit 32 and the third compensation parameter look-up unit 33 may specifically be the liquid crystal over drive controller (ODC, over drive controller) based on the liquid crystal over drive technology having the function of liquid crystal overdriving or devices having the equivalent function of looking up the data and outputting the data. The specific manner thereof for the implementation is not limited in the embodiment.

In an embodiment, the first compensation parameter look-up table, the second compensation parameter look-up table and the third compensation parameter look-up table may specifically be the look-up table (LUT, look-up-table) or also other tables having the equivalent function of data input, that is, looking the corresponding output data up according to the input data or the random access memory (RAM) kind of storage medium.

In an embodiment, the data look-up method mentioned above for finding the data interval of the compensation drive data first and calculating the compensation drive data in the data interval through the interpolation method may also be equivalently applied to the first compensation parameter look-up unit 31, the second compensation parameter look-up unit 32 and the third compensation parameter look-up unit 33.

In an embodiment, the first color sub-pixels, the second color sub-pixels and the third color sub-pixels are the red sub-pixels, the green sub-pixels and the blue sub-pixels respectively. The first compensation parameter look-up table, the second compensation parameter look-up table and the third compensation parameter look-up table are the red sub-pixel compensation parameter look-up table, the green sub-pixel compensation parameter look-up table and the blue sub-pixel compensation parameter look-up table. In the specific application, colors of the sub-pixels are not limited to red, green and blue, and may further comprise other colors such as white and yellow.

Figure 4:
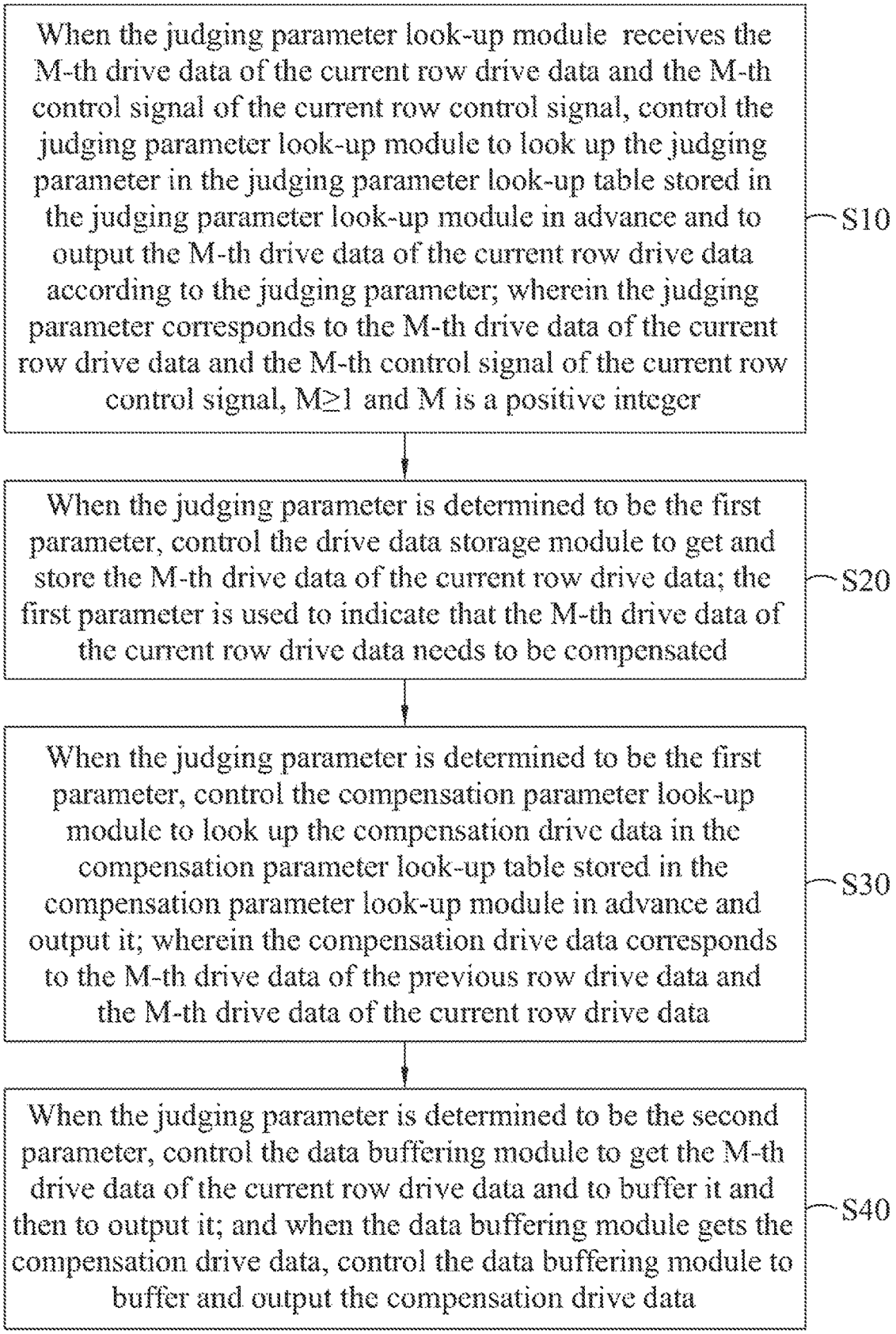
FIG. 4 is the flow chart of a driving method of a display panel according to an embodiment of the present application.

As shown in FIG. 4, an embodiment of the present application provides a driving method for a display panel implemented via the driving device 100 of the embodiment corresponding to FIG. 1 comprising the steps S10, S20, S30 and S40 described below.

Step S10: when the judging parameter look-up module 10 receives the M-th drive data of the current row drive data and the M-th control signal of the current row control signal, control the judging parameter look-up module 10 to look up the judging parameter in the judging parameter look-up table stored in the judging parameter look-up module 10 in advance and to output the M-th drive data of the current row drive data according to the judging parameter; wherein the judging parameter corresponds to the M-th drive data of the current row drive data and the M-th control signal of the current row control signal, $M \geq 1$ and M is a positive integer.

Step S20: when the judging parameter is determined to be the first parameter, control the drive data storage module 20 to get and store the M-th drive data of the current row drive data; the first parameter being used to indicate that the M-th drive data of the current row drive data needs to be compensated for.

Step S30: when the judging parameter is determined to be the first parameter, control the compensation parameter look-up module 30 to look up the compensation drive data in the compensation parameter look-up table stored in the compensation parameter look-up module 30 in advance and output it; wherein the compensation drive data corresponds to the M-th drive data of the previous row drive data and the M-th drive data of the current row drive data.

Step S40: when the judging parameter is determined to be the second parameter, control the data buffering module 40 to get the M-th drive data of the current row drive data and to buffer it and then to output it; and when the data buffering module 40 gets the compensation drive data, control the data buffering module 40 to buffer and output the compensation drive data.

In the specific application, the steps S10-S40 may be implemented through a control module so as to control the judging parameter look-up module 10, the drive data storage module 20, the compensation parameter look-up module 30 and the data buffering module 40 respectively.

In the specific application, the control module may be implemented through the general purpose integrated circuit such as CPU (Central Processing Unit, CPU) or through the ASIC (Application Specific Integrated Circuit). The control module may be the timing controller (TCON, Time Controller) of the display device as well.

In an embodiment, the step S30 specifically comprises: when the judging parameter is determined to be the first parameter, control the compensation parameter look-up module 30 to look up a numeral value range in the compensation parameter look-up table stored in the compensation parameter look-up module 30 in advance, the numeral value range corresponding to the M-th drive data of the previous row drive data and the M-th drive data of the current row drive data; and control the compensation parameter look-up module 30 to calculate the numeral values of the numeral value range through the interpolation method to get the compensation drive data.

In the present application, whether the M-th drive data of the row drive data received currently needs to be compensated for or not is determined. When compensation is needed, the M-th data of the current row drive data needing to be compensated for is compensated through the corresponding compensation drive data looked up according to the M-th drive data of the previous row drive data and the M-th drive data of the current row drive data so as to effectively eliminate the light and dark stripes or the grid phenomenon of the liquid crystal display panel.

Figure 5:
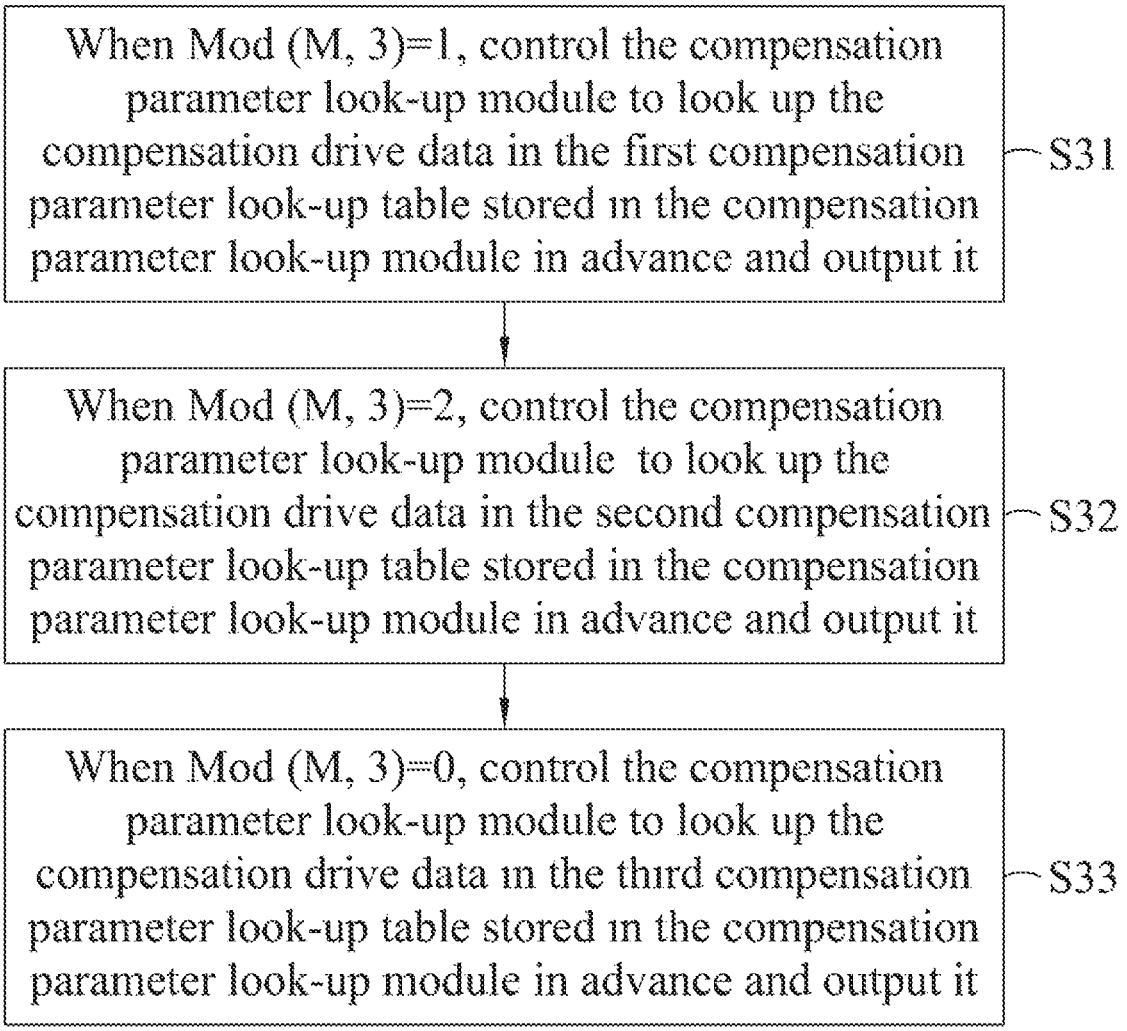
FIG. 5 is the flow chart of the step S30 according to an embodiment of the present application.

As shown in FIG. 5, in an embodiment, the step S30 of the embodiment corresponding to FIG. 4 comprises the steps (S31-S33) implemented via the compensation parameter look-up module 30 corresponding to FIG. 3 as described below.

Step S31: when Mod (M, 3)=1, control the compensation parameter look-up module 30 to look up the compensation drive data in the first compensation parameter look-up table stored in the compensation parameter look-up module 30 in advance and output it.

Step S32: when Mod (M, 3)=2, control the compensation parameter look-up module 30 to look up the compensation drive data in the second compensation parameter look-up table stored in the compensation parameter look-up module 30 in advance and output it.

Step S33: when Mod (M, 3)=0, control the compensation parameter look-up module 30 to look up the compensation drive data in the third compensation parameter look-up table stored in the compensation parameter look-up module 30 in advance and output it.

In an embodiment, the steps S31-S33 are specifically implemented via a control module to control the first compensation parameter look-up unit 31, the second compensation parameter look-up unit 32 and the third compensation parameter look-up unit 33 of the compensation parameter look-up module 30 respectively.

Figure 6:
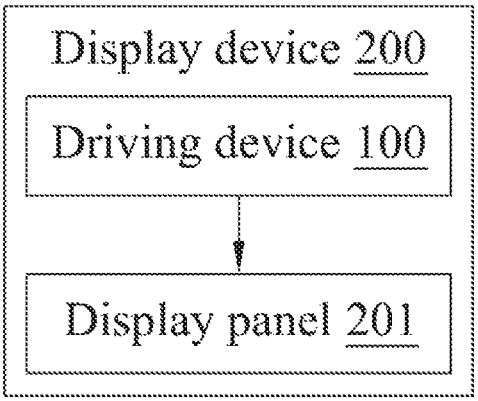
FIG. 6 is the structure illustration of a display device according to an embodiment of the present application.

As shown in FIG. 6, one embodiment of the present application further provides a display device 200 comprising the display panel 201 and the driving device 100 described above.

In an embodiment, the display panel 201 may be any type of display panel, for example, the liquid crystal display panel based on LCD (Liquid Crystal Display) technology, the organic electroluminescence display panel based on OLED (Organic Electroluminescence Display) technology, the quantum dot light emitting diode display panel based on the QLED (Quantum Dot Light Emitting Diodes) technology or the curved display panel.

In an embodiment, all the modules or units in the embodiment of the present application may be implemented through the general purpose integrated circuit such as CPU (Central Processing Unit) or through the ASIC (Application Specific Integrated Circuit).

A person skilled in the art may understand that all or parts of the processes of the methods in the foregoing embodiments may be implemented via correlated hardware instructed through a computer program. The program may be stored in a computer-readable storage medium, and, when executed, may comprise the processes of the embodiments of the foregoing methods, wherein the storage medium may be a disk, an optical disk, a read-only memory (Read-Only Memory, ROM) a random access memory (Random Access Memory, RAM), or the like.

The above descriptions are merely the preferred embodiments of the present application and are not intended to limit the present application. Any modification, equivalent replacement and improvement made within the spirit and principle of the present application should be included in the protection scope of the present application.

What is claimed is:

1. A driving device of a display panel comprising:

a judging parameter look-up module looking up a judging parameter in a judging parameter look-up table stored in the judging parameter look-up module in advance and outputting drive data corresponding to an M-th drive data of a current row drive data according to the judging parameter when receiving the M-th drive data of the current row drive data and a M-th control signal of the current row control signal;

wherein the judging parameter corresponds to the M-th drive data of the current row drive data and the M-th control signal of the current row control signal, where M≥1 and M is a positive integer;

a drive data storage module connected to the judging parameter look-up module and storing a M-th drive data of a previous row drive data in advance and to get and to store the M-th drive data of the current row drive data when the judging parameter is determined to be a first parameter, the first parameter being used to indicate that the M-th drive data of the current row drive data needs to be compensated for;

a compensation parameter look-up module connected to the judging parameter look-up module and the drive data storage module respectively and looking up a compensation drive data in a compensation parameter look-up table stored in the compensation parameter look-up module in advance and outputting the compensation drive data when the judging parameter is determined to be the first parameter;

wherein the compensation drive data corresponds to the M-th drive data of the previous row drive data and the M-th drive data of the current row drive data; and a data buffering module connected to the judging parameter look-up module and the compensation parameter look-up module and buffering and then outputting the M-th drive data of the current row drive data when the judging parameter is determined to be a second parameter; the data buffering module buffering and outputting the compensation drive data after getting the compensation drive data;

wherein a first input terminal of the judging parameter look-up module inputs the M-th control signal, a second input terminal of the judging parameter look-up module inputs the M-th drive data, a first output terminal of the judging parameter look-up module connects to a first input terminal of the data buffering module, a second output terminal of the judging parameter look-up module, a input/output terminal of the drive data storage module and a input terminal of the compensation parameter look-up module are connected to each other; an output terminal of the compensation parameter look-up module connects to a second input terminal of the data buffering module; and an output terminal of the data buffering module outputs data to the sub-pixels of each row of the display panel.

2. The driving device of the display panel of claim 1, wherein the display panel comprises sub-pixels in a pattern of m rows and n columns, each column of the sub-pixels comprises a plurality of sets of the sub-pixels, and each set of the sub-pixels comprises a first color sub-pixel, a second color sub-pixel and a third color sub-pixel arranged in sequence; wherein n≥m≥1 and m and n are positive integers.

3. The driving device of the display panel of claim 2, wherein the compensation parameter look-up table comprises a first compensation parameter look-up table, a second compensation parameter look-up table and a third compensation parameter look-up table corresponding to the first color sub-pixel, the second color sub-pixel and the third color sub-pixel respectively.

4. The driving device of the display panel of claim 3, wherein the compensation parameter look-up module comprises:

a first compensation parameter look-up unit storing the first compensation parameter look-up table in advance and, when Mod (M,3)=1, look-up and output the compensation drive data in the first compensation parameter look-up table;

a second compensation parameter look-up unit storing the second compensation parameter look-up table in advance and, when Mod (M,3)=2, look-up and output the compensation drive data in the second compensation parameter look-up table;

a third compensation parameter look-up unit storing the third compensation parameter look-up table in advance and, when Mod (M,3)=0, look-up and output the compensation drive data in the third compensation parameter look-up table;

wherein Mod (number, divisor) function represents the remainder function, the number represents the dividend and the divisor represents the divisor.

5. The driving device of the display panel of claim 1, wherein the compensation parameter look-up module further looks up a numeral value range in the compensation parameter look-up table when the judging parameter is determined to be the first parameter, the numeral value range corresponds to the M-th drive data of the previous row drive data and the M-th drive data of the current row drive data; and wherein the compensation parameter look-up module further calculates numeral values in the numeral value range through the interpolation method to get the compensation drive data.

6. A driving method of a display panel comprising:

controlling a judging parameter look-up module to look up a judging parameter in a judging parameter look-up table stored in the judging parameter look-up module in advance when the judging parameter look-up module receives a M-th drive data of the current row drive data and a M-th control signal of the current row control signal, and to output the M-th drive data of the current row drive data according to the judging parameter;

wherein the judging parameter corresponds to the M-th drive data of the current row drive data and the M-th control signal of the current row control signal, M≥1 and M is a positive integer;

controlling a drive data storage module to get and store the M-th drive data of the current row drive data when the judging parameter is determined to be a first parameter, the first parameter being used to indicate that the M-th drive data of the current row drive data needs to be compensated for;

controlling a compensation parameter look-up module to look up and output a compensation drive data in a compensation parameter look-up table stored in the compensation parameter look-up module in advance when the judging parameter is determined to be the first parameter; wherein the compensation drive data corresponds to a M-th drive data of the previous row drive data and the M-th drive data of the current row drive data;

controlling a data buffering module to get the M-th drive data of the current row drive data and to buffer and then output the M-th drive data of the current row drive data; controlling the data buffering module to buffer and output the compensation drive data when the data buffering module receives the compensation drive data;

wherein a first input terminal of the judging parameter look-up module inputs the M-th control signal, a second input terminal of the judging parameter look-up module inputs the M-th drive data, a first output terminal of the judging parameter look-up module connects to a first input terminal of the data buffering module, a second output terminal of the judging parameter look-up module, a input/output terminal of the drive data storage module and an input terminal of the compensation parameter look-up module are connected to each other; an output terminal of the compensation parameter look-up module connects to a second input terminal of the data buffering module; and an output terminal of the data buffering module outputs data to the sub-pixels of each row of the display panel.

7. The driving method of the display panel of claim 6, wherein the display panel comprises sub-pixels in a pattern of m rows and n columns, each column of the sub-pixels comprises a plurality of sets of the sub-pixels, and each set of the sub-pixels comprises a first color sub-pixel, a second color sub-pixel and a third color sub-pixel arranged in sequence; wherein n≥m≥1 and m and n are positive integers.

8. The driving method of the display panel of claim 7, wherein the compensation parameter look-up table comprises:

a first compensation parameter look-up table corresponding to the first color sub-pixel;

a second compensation parameter look-up table corresponding to the second color sub-pixel; and a third compensation parameter look-up table corresponding to the third color sub-pixel.

9. The driving method of the display panel of claim 8, wherein the compensation parameter look-up module looks up and outputs the compensation drive data in the compensation parameter look-up table stored in the compensation parameter look-up module in advance comprises:

controlling the compensation parameter look-up module to look up and output the compensation drive data in the first compensation parameter look-up table stored in the compensation parameter look-up module in advance when Mod (M, 3)=1;

controlling the compensation parameter look-up module to look up and output the compensation drive data in the second compensation parameter look-up table stored in the compensation parameter look-up module in advance when Mod (M, 3)=2;

controlling the compensation parameter look-up module to look up and output the compensation drive data in the third compensation parameter look-up table stored in the compensation parameter look-up module in advance when Mod (M, 3)=0;

wherein Mod (number, divisor) function represents the remainder function, the number represents the dividend and the divisor represents the divisor.

10. The driving method of the display panel of claim 6, wherein controlling the compensation parameter look-up module to look up and output the compensation drive data in the compensation parameter look-up table stored in the compensation parameter look-up module in advance comprises:

controlling the compensation parameter look-up module to look up a numeral value range in the compensation parameter look-up table stored in the compensation parameter look-up module in advance when the judging parameter is determined to be the first parameter, wherein the numeral value range corresponding to the M-th drive data of the previous row drive data and the M-th drive data of the current row drive data; and controlling the compensation parameter look-up module to calculate numeral values in the numeral value range through the interpolation method to get the compensation drive data.

11. A driving device of a display panel, the driving device comprising:

a judging parameter look-up module looking up a judging parameter in a judging parameter look-up table stored in the judging parameter look-up module in advance and outputting a M-th drive data of the current row drive data according to the judging parameter when receiving the M-th drive data of the current row drive data and a M-th control signal of the current row control signal;

wherein the judging parameter corresponds to the M-th drive data of the current row drive data and the M-th control signal of the current row control signal, M≥1 and M is a positive integer;

wherein the judging parameter comprises a first parameter indicating that the M-th drive data of the current row drive data needs to be compensated for and a second parameter indicating that the M-th drive data of the current row drive data do not need to be compensated for;

a drive data storage module connected to the judging parameter look-up module and storing a M-th drive data of the previous row drive data in advance and to get and to store the M-th drive data of the current row drive data when the judging parameter is determined to be the first parameter;

a compensation parameter look-up module connected to the judging parameter look-up module and the drive data storage module respectively and looking up a numeral value range in a compensation parameter look-up table stored in the compensation parameter look-up module in advance and to get and outputting a compensation drive data by calculating numeral values in the numeral value range through the interpolation method when the judging parameter is determined to be the first parameter;

wherein the compensation drive data corresponds to the M-th drive data of the previous row drive data and the M-th drive data of the current row drive data; and a data buffering module connected to the judging parameter look-up module and the compensation parameter look-up module and buffering and then outputting the M-th drive data of the current row drive data when the judging parameter is determined to be the second parameter; the data buffering module buffering and outputting the compensation drive data after getting the compensation drive data;

wherein a first input terminal of the judging parameter look-up module inputs the M-th control signal, a second input terminal of the judging parameter look-up module inputs the M-th drive data, a first output terminal of the judging parameter look-up module connects to a first input terminal of the data buffering module, a second output terminal of the judging parameter look-up module, an input/output terminal of the drive data storage module and a input terminal of the compensation parameter look-up module are connected to each other; an output terminal of the compensation parameter look-up module connects to a second input terminal of the data buffering module; and an output terminal of the data buffering module outputs data to the sub-pixels of each row of the display panel.

12. The driving device of claim 11, wherein the display panel comprises sub-pixels in a pattern of m rows and n columns, each column of the sub-pixels comprises a plurality of sets of the sub-pixels, and each set of the sub-pixels comprises a first color sub-pixel, a second color sub-pixel and a third color sub-pixel arranged in sequence; wherein $n \geq m \geq 1$ and m and n are positive integers, wherein Mod (number, divisor) function represents the remainder function, the number represents the dividend and the divisor represents the divisor.

13. The driving device of claim 12, wherein the compensation parameter look-up table comprises a first compensation parameter look-up table, a second compensation parameter look-up table and a third compensation parameter look-up table corresponding to the first color sub-pixel, the second color sub-pixel and the third color sub-pixel respectively.

14. The driving device of claim 13, wherein the compensation parameter look-up module comprises:

a first compensation parameter look-up unit storing the first compensation parameter look-up table in advance and, when Mod (M,3)=1, look-up and output the compensation drive data in the first compensation parameter look-up table;

a second compensation parameter look-up unit storing the second compensation parameter look-up table in advance and, when Mod (M,3)=2, look-up and output the compensation drive data in the second compensation parameter look-up table;

a third compensation parameter look-up unit storing the third compensation parameter look-up table in advance and, when Mod (M,3)=0, look-up and output the compensation drive data in the third compensation parameter look-up table.

15. The driving device of claim 11, wherein the numeral value range corresponds to the M-th drive data of the previous row drive data and the M-th drive data of the current row drive data.

* * * * *